US009126313B1

(12) United States Patent
Peterson

(10) Patent No.: US 9,126,313 B1
(45) Date of Patent: Sep. 8, 2015

(54) MAGNET SYSTEM FOR REMOVABLE ATTACHMENT OF A BAG TO A WATER BOARD

(71) Applicant: Sean Peterson, San Jose, CA (US)

(72) Inventor: Sean Peterson, San Jose, CA (US)

( * ) Notice: Subject to any disclaimer, the term of this patent is extended or adjusted under 35 U.S.C. 154(b) by 122 days.

(21) Appl. No.: 13/965,706

(22) Filed: Aug. 13, 2013

(51) Int. Cl.
*B25B 11/00* (2006.01)
*H01F 7/00* (2006.01)

(52) U.S. Cl.
CPC ..... *B25B 11/002* (2013.01); *H01F 7/00* (2013.01)

(58) Field of Classification Search
CPC ..... B25B 11/002; H01F 7/00
USPC ..... 224/406
See application file for complete search history.

(56) References Cited

U.S. PATENT DOCUMENTS

| | | | | | |
|---|---|---|---|---|---|
| 2,288,105 | A * | 6/1942 | Plotkin | 190/119 |
| 3,667,597 | A * | 6/1972 | Hollister | 242/564 |
| 4,059,207 | A * | 11/1977 | Jackson et al. | 224/413 |
| 4,303,184 | A * | 12/1981 | Kloth | 224/447 |
| 4,469,256 | A * | 9/1984 | McEwen | 224/413 |
| 4,885,195 | A * | 12/1989 | Change, III | 428/36.1 |
| 5,001,779 | A * | 3/1991 | Eggert et al. | 455/346 |
| 5,367,278 | A * | 11/1994 | Yoshikawa | 335/285 |
| 5,996,116 | A * | 12/1999 | Tate | 2/12 |
| 6,305,590 | B1 * | 10/2001 | Hayes | 224/413 |
| 6,401,253 | B2 * | 6/2002 | Brunson | 2/160 |
| 8,567,649 | B1 * | 10/2013 | Cabak | 224/312 |
| 2004/0200868 | A1 * | 10/2004 | Woodman | 224/221 |
| 2006/0278675 | A1 * | 12/2006 | Squitieri | 224/581 |
| 2007/0199966 | A1 | 8/2007 | Korchmar | |
| 2009/0014105 | A1 * | 1/2009 | Shattuck | 150/147 |
| 2009/0095751 | A1 * | 4/2009 | Hamlin | 220/230 |
| 2011/0233249 | A1 * | 9/2011 | Nakajima | 224/545 |
| 2013/0098954 | A1 * | 4/2013 | Inglis | 224/148.4 |
| 2013/0122761 | A1 | 5/2013 | Macias | |
| 2013/0292431 | A1 * | 11/2013 | Christian | 224/164 |

* cited by examiner

*Primary Examiner* — Brian D Nash
(74) *Attorney, Agent, or Firm* — Douglas L. Weller

(57) ABSTRACT

A magnet system for removable attachment of a bag to a water board preferably includes at least one magnet and at least metal disc. The at least one magnet is retained in or on a bottom of a bag. The at least one metal disc must fabricated of a ferrous material, such as steel. The at least one metal disc is coated with a water impermeable substance to prevent rusting. The at least one metal disc is retained on a surface of the water board. The bag will be removably retained relative to the water board, when a magnetic field of the at least one magnet is in contact with the at least one metal disc.

10 Claims, 4 Drawing Sheets

MAGNET SYSTEM FOR REMOVABLE ATTACHMENT OF A BAG TO A WATER BOARD

BACKGROUND OF THE INVENTION

1. Field of the Invention

The present invention relates generally to attaching bags to objects and more specifically to a magnet system for removable attachment of a bag to a water board, which allows a bag to be removably secured to a water board.

2. Discussion of the Prior Art

Patent application no. 2007/0199966 to Korchmar discloses an article storage bag. The Korchmar patent application teaches a handbag with a magnetic closure system for removably retaining a flap against a side of a storage bag body. Patent application no. 2013/0122761 to Macias discloses a stand up paddleboard sweeper. The Macias patent application teaches the attachment of a bag to a paddle board with fasteners.

Accordingly, there is a clearly felt need in the art for a magnet system for removable attachment of a bag to a water board, which allows a bag to be removably secured to a water board, such as a surf board or paddle board.

SUMMARY OF THE INVENTION

The present invention provides a magnet system for removable attachment of a bag to a water board, which allows a bag to be removably secured to a water board. The magnet system for removable attachment of a bag to a water board (magnet system for bag attachment) preferably includes at least one magnet and at least one metal disc. The at least one magnet is retained in or on a bottom of a bag. The at least one magnet is preferably retained in a bottom wall of the bag; attached to the bag with a piece of double sided tape; or attached to the bag with any other suitable attachment method. The at least one metal disc must fabricated of a ferrous material, such as steel. The at least one metal disc is coated with a water impermeable substance to prevent rusting. The at least one metal disc is retained on a surface of the water board. The at least one metal disc may be attached to the water board with a piece of double sided tape; pressed into a bore formed in the water board; or secured to the water board with any other suitable method. The bag will be removably retained relative to the water board, when a magnetic field of the at least one magnet is in contact with the at least one metal disc.

Accordingly, it is an object of the present invention to provide a magnet system for bag attachment, which allows a bag to removably secured to a water board, such as a surf board or paddle board.

These and additional objects, advantages, features and benefits of the present invention will become apparent from the following specification.

DETAILED DESCRIPTION OF THE PREFERRED EMBODIMENTS

Figure 1:
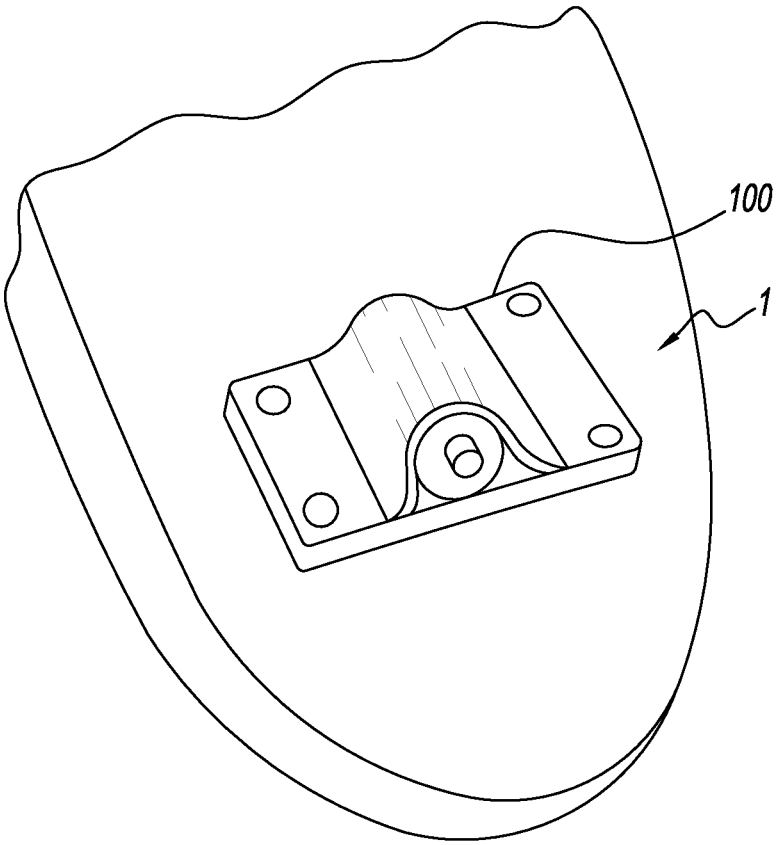
FIG. 1 is a perspective view of a bag removably secured to a water board with a magnet system for bag attachment in accordance with the present invention.
Figure 2:
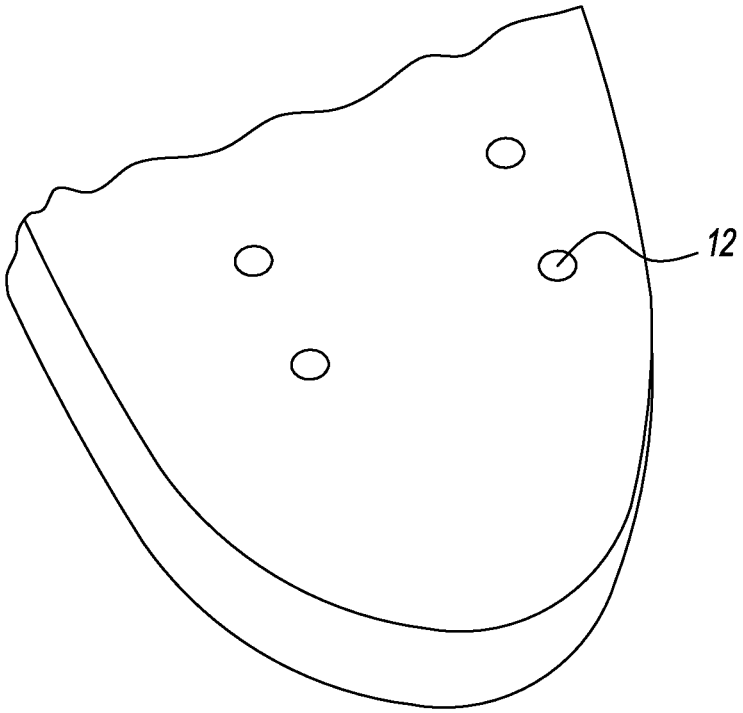
FIG. 2 is a perspective view of a water board with four metal discs retained thereupon of a magnet system for bag attachment in accordance with the present invention.
Figure 3A:
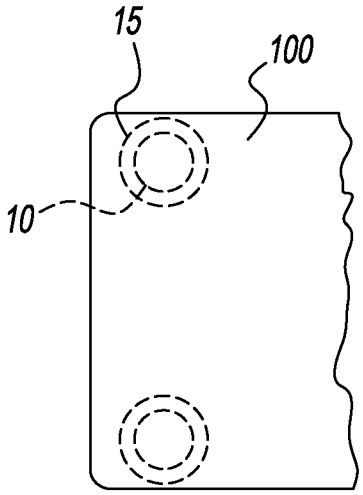
FIG. 3*a* is a bottom view of a left portion of a bag with two magnets retained therein of a magnet system for bag attachment in accordance with the present invention.
Figure 3B:
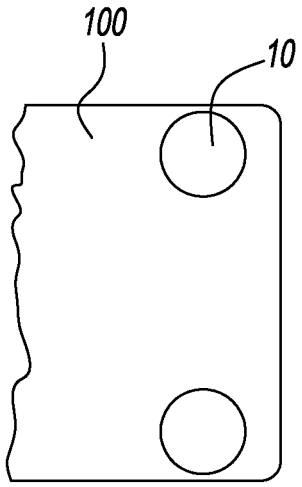
FIG. 3*b* is a bottom view of a right portion of a bag with two magnets retained thereon of a magnet system for bag attachment in accordance with the present invention.
Figure 4:
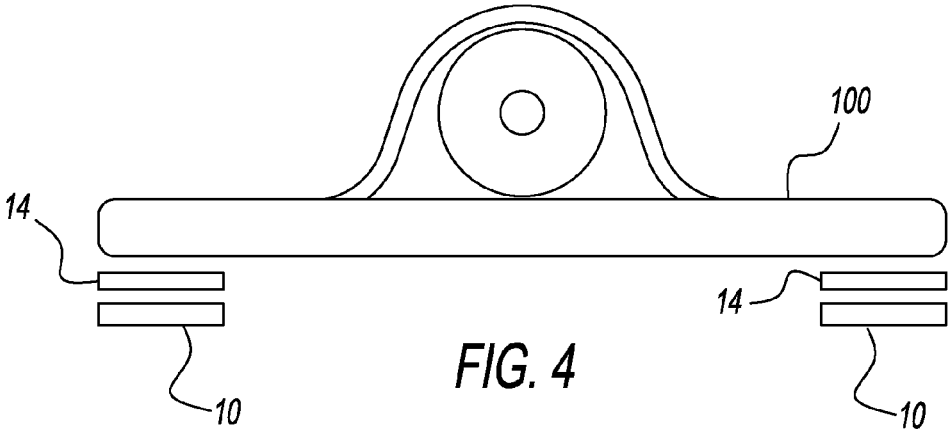
FIG. 4 is a partially exploded end view of a bag with at least one magnet and a securing device of a magnet system for bag attachment in accordance with the present invention.
Figure 5:
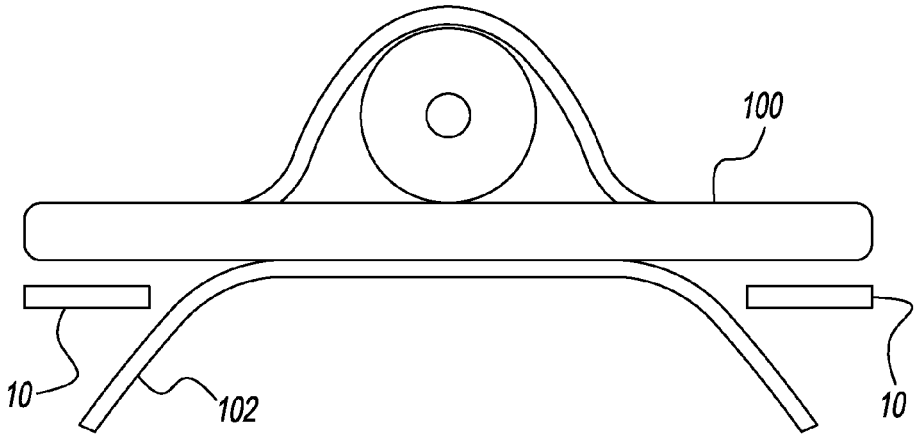
FIG. 5 is a partially exploded end view of a bag with at least one magnet of a magnet system for bag attachment in accordance with the present invention.

With reference now to the drawings, and particularly to FIG. 1, there is shown a perspective view of a magnet system for bag attachment 1. With reference to FIGS. 2-3*b*, the magnet system for bag attachment 1 preferably includes at least one magnet 10 and at least metal disc 12. The at least one magnet 10 is retained in or on a bottom of a bag 100. With reference to FIGS. 4-5, the at least on magnet 10 is preferably retained in a bottom wall 102 of the bag 100; attached to the bag 100 with a piece of double sided tape 14; or attached with any other suitable attachment method. The at least one magnet 10 may be retained in a bottom of the bag 100 by retaining the at least one magnet 10 between two pieces of material in the bottom wall 102 and sewing thread 15 around at least a portion of the perimeter of the at least one magnet 10. The at least one metal disc 12 must fabricated of a ferrous material, such as steel.

Figure 6:
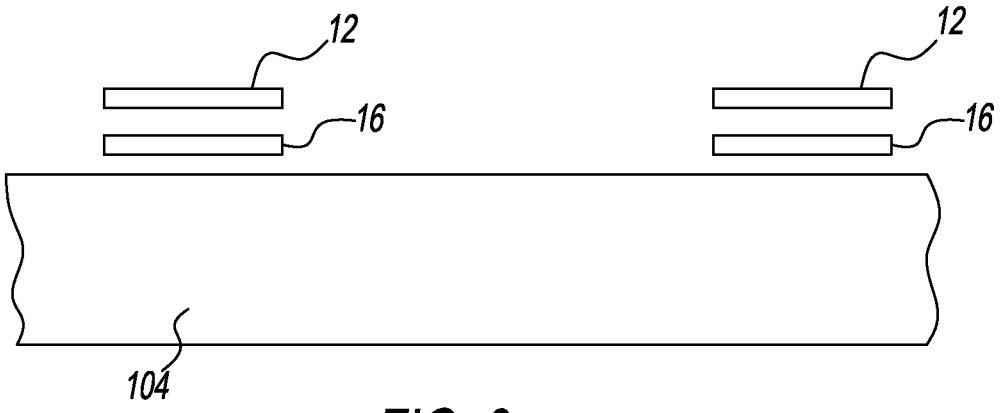
FIG. 6 is a partially exploded end view of a water board with at least one magnet and a securing device of a magnet system for bag attachment in accordance with the present invention.
Figure 7:
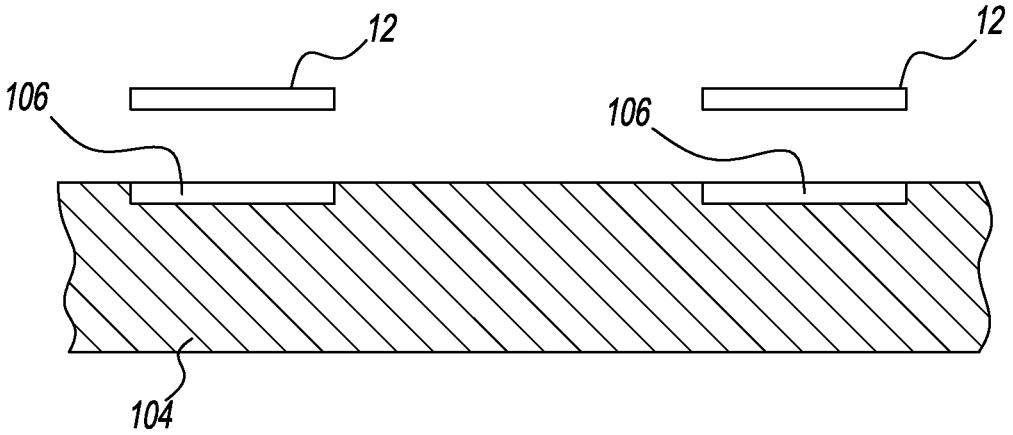
FIG. 7 is a partially exploded cross sectional end view of a water board with at least one magnet of a magnet system for bag attachment in accordance with the present invention.

With reference to FIGS. 6-7, the at least one metal disc 12 is coated with a water impermeable substance to prevent rusting. The at least one metal disc 12 is retained on a surface of a water board 104. The at least one metal disc 12 may be attached to a water board 104 with a piece of double sided tape 16; pressed into a bore 106 formed in the water board 104; or secured to the water board 104 with any other suitable method. The bag 100 will be removably retained relative to the water board 104, when a magnetic field of the at least one magnet 10 is in contact with the at least one metal disc 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A water board storage system comprising: a water board, the water board including: a plurality of metal pieces attached at or near a top surface of the water board, each metal piece in the plurality of metal pieces being composed of ferrous material, and each metal piece being coated with a water impermeable substance to prevent rusting; and, a bag, the bag including a plurality of magnets located at a bottom of the bag, wherein the plurality of magnets are configured so that the plurality of magnets align with the plurality of metal pieces allowing the bag to be attached to the water board by the magnetic bond formed between the plurality of magnets and the plurality of metal pieces.

2. A water board storage system as in claim 1 wherein the metal pieces are embedded in a bore within the water board so that a surface of the water board is smooth at a location where the metal pieces are embedded within the water board.

3. A water board storage system as in claim 1 wherein a bond between the surface of the water board and the metal pieces is formed using double sided tape.

4. A water board storage system as in claim 1 wherein the metal pieces are embedded in a bore within the water board.

5. A water board storage system as in claim 1 wherein the metal pieces are metal disks.

6. A method for providing a storage compartment on a water board, comprising:

attaching at least one metal piece to a top surface of the water board, the at least one metal piece being composed of ferrous material, and the at least one metal piece being coated with a water impermeable substance to prevent rusting; and, attaching a bag to the water board by a magnetic bond formed between at least one magnet located at a bottom of the bag and the at least one metal piece, wherein the at least one magnet is configured so that the at least one magnet aligns with the at least one metal piece allowing the bag to be attached to the water board by the magnetic bond formed between the at least one magnet and the at least one metal piece.

7. A method as in claim 6 wherein attaching the at least one metal piece includes embedding the at least one metal piece in a bore within the water board so that a surface of the water board is smooth at a location where the at least one metal piece is embedded within the water board.

8. A method as in claim 6 wherein attaching the at least one metal piece includes using double sided tape to form a bond between the surface of the water board and the at least one metal piece.

9. A method as in claim 6 wherein attaching the at least one metal piece includes embedding the at least one metal piece in a bore within the water board.

10. A method as in claim 6 wherein the at least one metal piece is at least one metal disk.

* * * * *